US011754299B2

(12) United States Patent
Sim et al.

(10) Patent No.: US 11,754,299 B2
(45) Date of Patent: Sep. 12, 2023

(54) AIR CONDITIONER AND PIPE INSTALLATION APPARATUS THEREFOR

(71) Applicant: Samsung Electronics Co., Ltd., Suwon-si (KR)

(72) Inventors: Jaehyoung Sim, Suwon-si (KR); Hyungmo Koo, Suwon-si (KR); Youjae Kim, Suwon-si (KR); Joonhyoung Kim, Suwon-si (KR); Hyunah Kim, Suwon-si (KR); Seonuk Na, Suwon-si (KR); Eomji Jang, Suwon-si (KR); Dongho Cho, Suwon-si (KR); Sungjune Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 296 days.

(21) Appl. No.: 17/104,934

(22) Filed: Nov. 25, 2020

(65) Prior Publication Data

US 2021/0156576 A1 May 27, 2021

(30) Foreign Application Priority Data

Nov. 26, 2019 (KR) ..... 10-2019-0153362

(51) Int. Cl.

| | |
|---|---|
| ***F24F 1/32*** | (2011.01) |
| ***F24F 1/34*** | (2011.01) |
| ***F24F 13/10*** | (2006.01) |
| ***F24F 13/20*** | (2006.01) |

(52) U.S. Cl.

CPC ..... *F24F 1/32* (2013.01); *F24F 1/34* (2013.01); *F24F 13/10* (2013.01); *F24F 13/20* (2013.01)

(58) Field of Classification Search

CPC .... F24F 1/32; F24F 1/0035; F24F 1/34; F24F 13/0227

See application file for complete search history.

(56) References Cited

U.S. PATENT DOCUMENTS 5,661,891 A * 9/1997 Miller ..... H02G 3/22 52/220.8

2017/0321399 A1 11/2017 Lee et al.

FOREIGN PATENT DOCUMENTS

| | | | |
|---|---|---|---|
| EP | 1061310 A2 * | 6/2000 | |
| JP | 59-170118 | 11/1984 | |
| JP | S5917018 U * | 11/1984 | |

(Continued)

OTHER PUBLICATIONS

International Search Report dated Mar. 16, 2021 in International Patent Application No. PCT/KR2020/016826.

*Primary Examiner* — Lionel Nouketcha

(74) *Attorney, Agent, or Firm* — STAAS & HALSEY LLP

(57) ABSTRACT

An air conditioner includes an indoor unit to be installed in indoor space, an outdoor unit to be installed in outdoor space, the outdoor unit being separated by a building wall from the indoor space, a refrigerant pipe to connect the indoor unit with the outdoor, a ventilation pipe to connect the indoor unit to the outdoor space, a ventilation device to be arranged in the indoor space and to be connected to the ventilation pipe to ventilate indoor air in the indoor space to outdoor space or outdoor air in the outdoor space to the indoor space through the ventilation pipe, and a sleeve to be installed to pass through a hole formed at the wall to guide the refrigerant pipe and the ventilation pipe therethrough.

13 Claims, 18 Drawing Sheets

(56) References Cited

FOREIGN PATENT DOCUMENTS

| | | | | |
|---|---|---|---|---|
| JP | 10-19303 | | | 1/1998 |
| JP | H1019303 | A | * | 1/1998 |
| JP | 2006-284150 | | | 10/2006 |
| JP | 2006284150 | A | * | 10/2006 |
| JP | 4245443 | | | 3/2009 |
| JP | 4683936 | | | 5/2011 |
| KR | 10-0360385 | | | 11/2002 |
| KR | 10-1114321 | | | 2/2012 |
| KR | 10-1162957 | | | 7/2012 |

* cited by examiner

AIR CONDITIONER AND PIPE INSTALLATION APPARATUS THEREFOR

CROSS-REFERENCE TO RELATED APPLICATIONS

This application is based on and claims priority under 35 U.S.C. § 119 to Korean Patent Application No. 10-2019-0153362 filed on Nov. 26, 2019, the disclosure of which is incorporated herein by reference in its entirety.

BACKGROUND

1. Field

The disclosure relates to an air conditioner having a ventilation device.

2. Description of the Related Art

An air conditioner is equipped with a compressor, a condenser, an expansion valve, an evaporator, a blower fan, and the like, for controlling indoor temperature, humidity, air currents, etc., using refrigeration cycles. The air conditioner may include an indoor unit placed indoors and an outdoor unit placed outdoors.

In general, ventilators like windows are all closed to prevent energy loss during operation of the air conditioner, in which case indoor carbon dioxide levels may increase. Hence, the air conditioner is sometimes equipped with a ventilation device to ventilate indoor air and outdoor air.

The air conditioner equipped with the ventilation device has a refrigerant pipe to make a refrigerant flow between an indoor unit and an outdoor unit, and a ventilation pipe to ventilate indoor air and outdoor air. Hence, to install the air conditioner equipped with the ventilation device, a hole for the refrigerant pipe and a hole for the ventilation pipe need to be made on a building wall.

SUMMARY

Additional aspects and/or advantages will be set forth in part in the description which follows and, in part, will be apparent from the description, or may be learned by practice of the invention.

The disclosure provides an air conditioner having a refrigerant pipe and a ventilation pipe installed in a single hole made on a wall.

The disclosure also provides an air conditioner allowing a hole for installation of a refrigerant pipe and a ventilation pipe to be minimized.

The disclosure also provides an air conditioner facilitating installation, maintenance and repair of a refrigerant pipe and a ventilation pipe.

According to an aspect of the disclosure, an air conditioner includes an indoor unit installed in indoor space; an outdoor unit installed in outdoor space separated by a building wall from the indoor space and connected to the indoor unit through a refrigerant pipe; a ventilation device arranged in the indoor space and connected to a ventilation pipe; and a pipe installation apparatus including a sleeve installed to pass through a hole formed at the building wall to guide installation of the refrigerant pipe and the ventilation pipe.

the sleeve may include a ventilation path connected to an internal flow path of the ventilation pipe; and a guide passage formed for the refrigerant pipe to pass through.

The ventilation path may be concavely formed to accommodate at least a portion of the guide passage.

The sleeve may include a sleeve body including an inner wall separating the ventilation path from the guide passage and an outer wall having the ventilation path formed between the outer wall and the inner wall.

The guide passage may be formed to have the form of a groove with one side open, and the sleeve may include a sleeve cover arranged to cover the open side of the guide passage.

The sleeve body and the sleeve cover may be attachable to each other to be coupled or detachable from each other to be uncoupled.

The sleeve body and the sleeve cover may be integrally formed.

The pipe installation apparatus may further include a hood cap arranged at an end on an outdoor side of the sleeve to be supported by an outer side of the building wall.

The hood cap may include an extension flow path connected to the ventilation path and an extension passage connected to the guide passage.

The pipe installation apparatus may further include a deco cap arranged at an end on an indoor side of the sleeve to be supported by an inner side of the building wall.

The pipe installation apparatus may further include a fixer coupled to the sleeve to fix the deco cap.

The pipe installation apparatus may further include a connecting pipe arranged between the ventilation pipe and the sleeve to connect between the ventilation pipe and the ventilation flow path of the sleeve.

The pipe installation apparatus may further include an opening/closing device provided at the connecting pipe to allow or prevent ventilation of indoor air and outdoor air.

The pipe installation apparatus may further include a holder coupled to the deco cap to fix the connecting pipe.

The ventilation device may be configured to switch between an air discharge mode to discharge indoor air to the outdoor space through the ventilation pipe and an air supply mode to supply outdoor air into the indoor space through the ventilation pipe.

According to another aspect of the disclosure, a pipe installation apparatus of an air conditioner includes a sleeve installed in a through hole formed on a building wall, and including a guide passage through which a refrigerant pipe passes and a ventilation path formed to ventilate indoor air and outdoor air; a hood cap arranged at an end of an outdoor side of the sleeve to fix the sleeve and supported by an outer side of the building wall; and a deco cap arranged at an end of an indoor side of the sleeve to fix the sleeve and supported by an inner side of the building wall.

The sleeve may have a cross-section, which is perpendicular to a direction of length of the sleeve, in a circular form to correspond to the through hole.

The ventilation path may be concavely formed to accommodate at least a portion of the guide passage.

The deco cap may include an alignment projection formed to guide a direction of installation of the sleeve.

The pipe installation apparatus may further include a connecting pipe including a connection flow path connected to the ventilation path, and a damper arranged at the connecting pipe to open or close the connection flow path.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION

Figure 1:
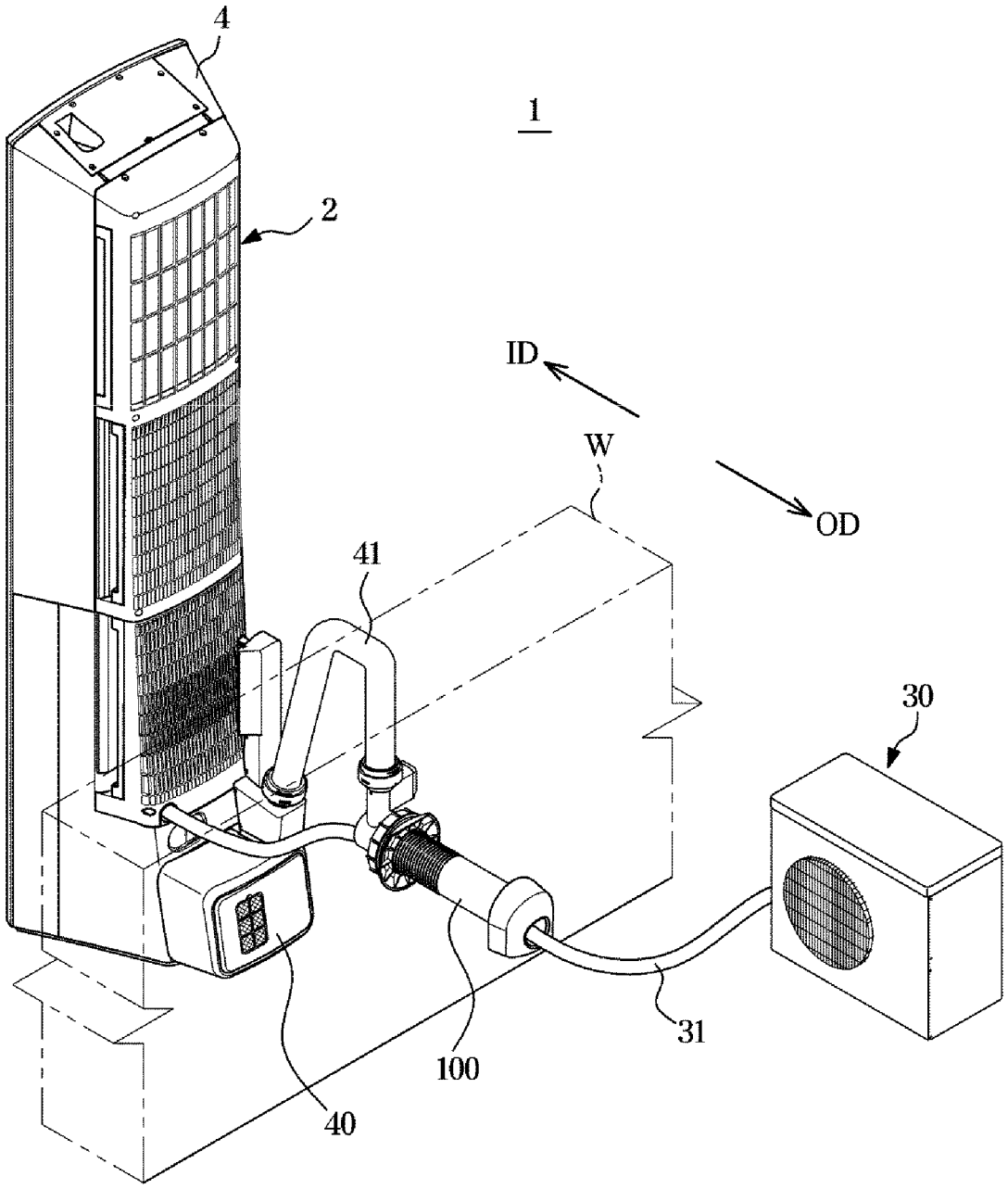
FIG. 1 is a perspective view of an air conditioner, according to an embodiment of the disclosure.

Embodiments of the disclosure are only the most preferred examples and provided to assist in a comprehensive understanding of the disclosure as defined by the claims and their equivalents. Accordingly, those of ordinary skilled in the art will recognize that various changes and modifications of the embodiments described herein can be made without departing from the scope and spirit of the disclosure.

It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another.

Reference will now be made in detail to embodiments, examples of which are illustrated in the accompanying drawings, wherein like reference numerals refer to the like elements throughout.

Figure 2:
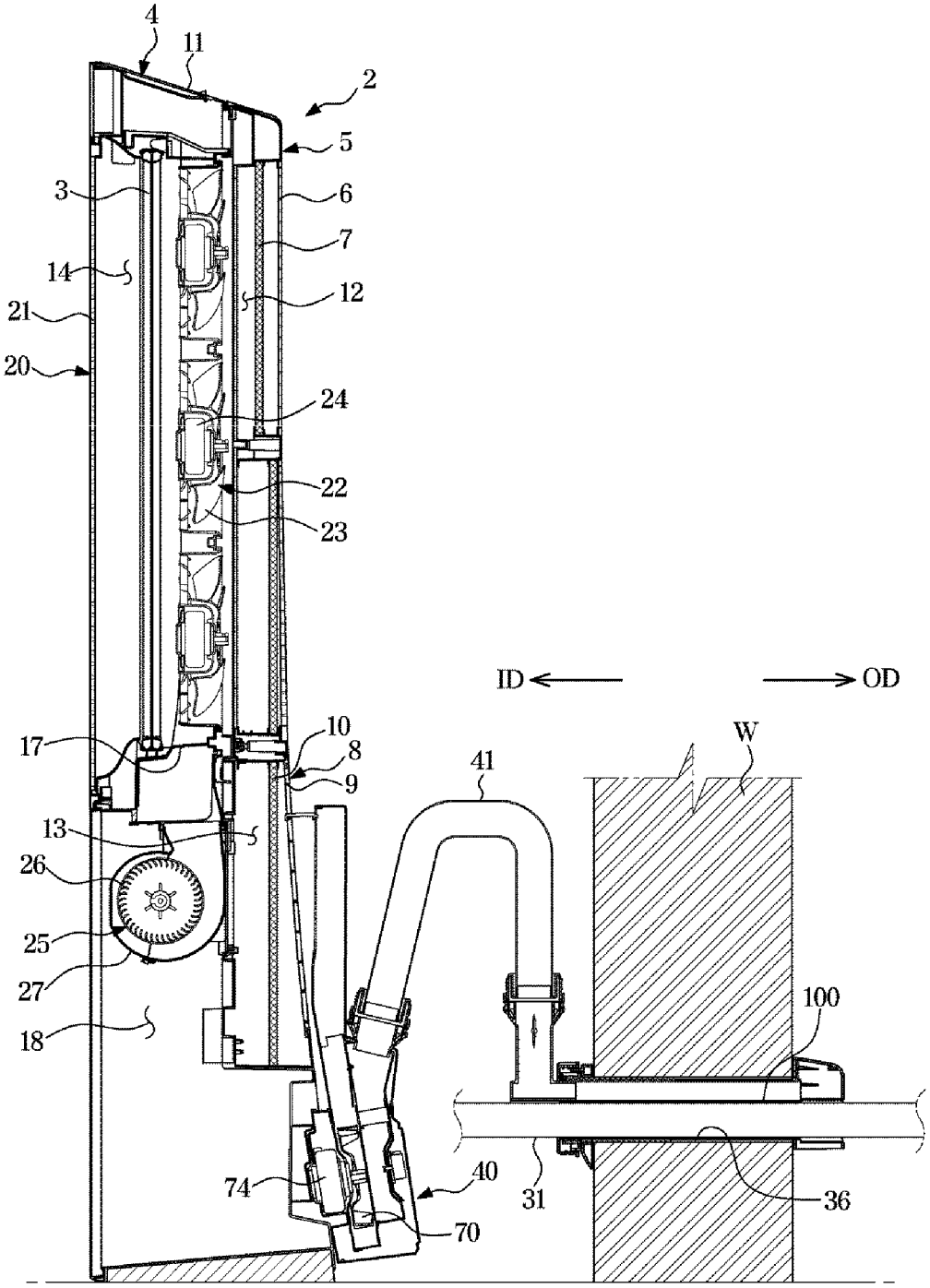
FIG. 2 is a side cross-sectional view of an air conditioner, according to an embodiment of the disclosure.
Figure 3:
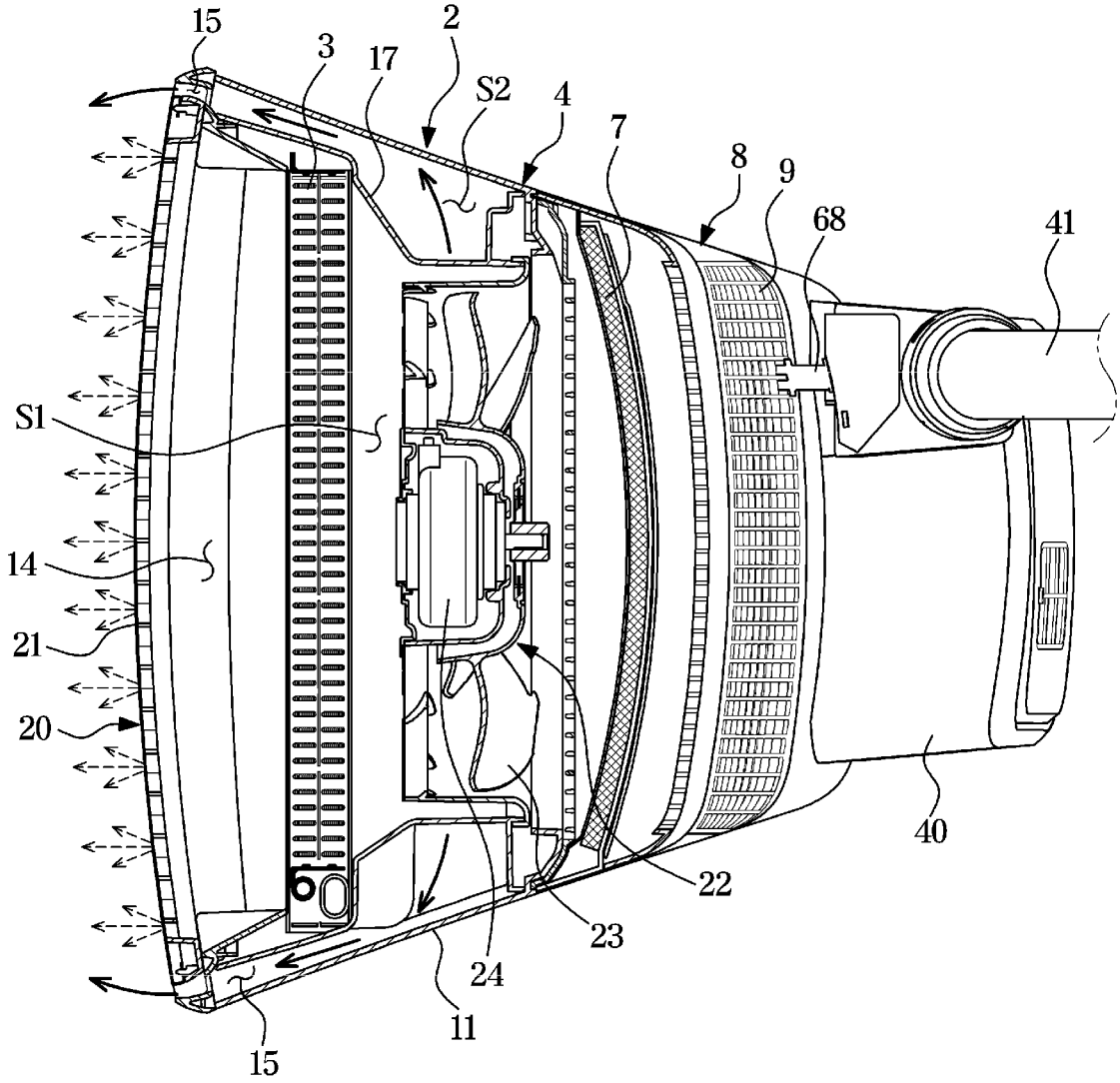
FIG. 3 is a cross-sectional view of an air conditioner, according to an embodiment of the disclosure.
Figure 4:
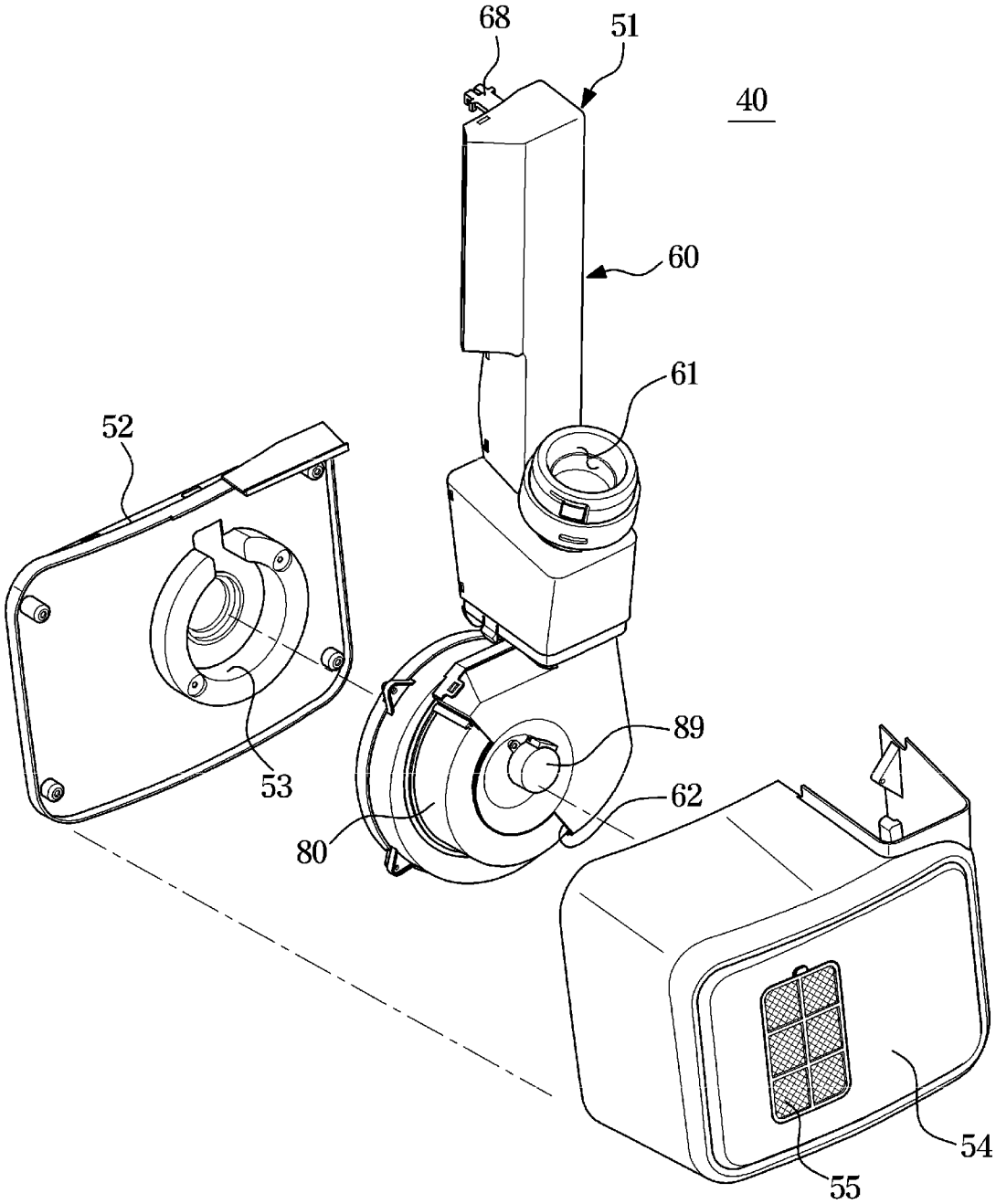
FIG. 4 shows a ventilation device, according to an embodiment of the disclosure.
Figure 5:
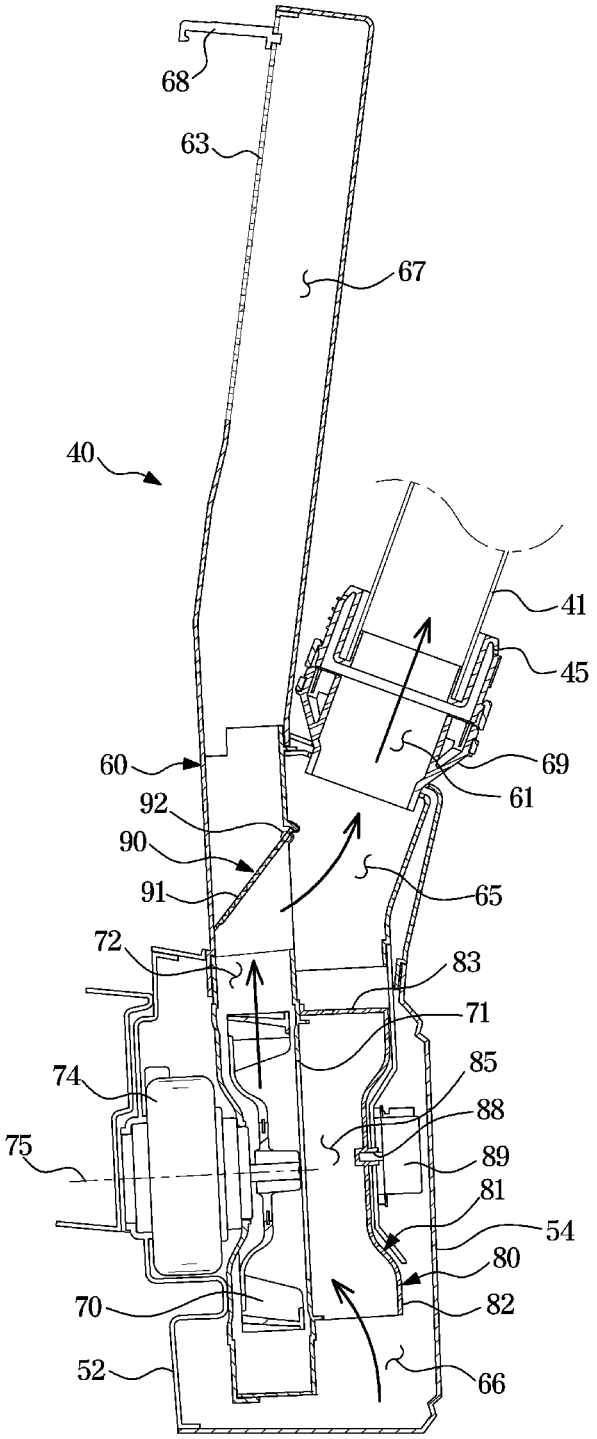
FIG. 5 shows an air discharge mode of a ventilation device, according to an embodiment of the disclosure.
Figure 6:
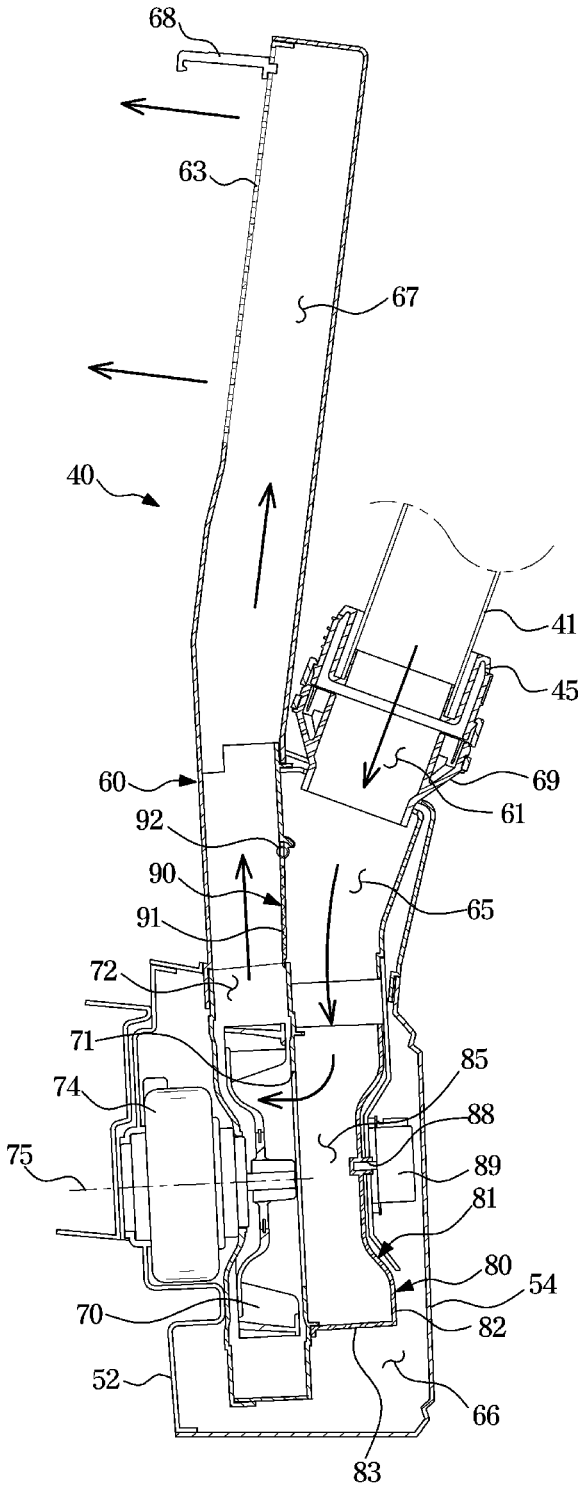
FIG. 6 shows an air supply mode of a ventilation device, according to an embodiment of the disclosure.

FIG. 1 is a perspective view of an air conditioner, according to an embodiment of the disclosure. FIG. 2 is a side cross-sectional view of an air conditioner, according to an embodiment of the disclosure. FIG. 3 is a cross-sectional view of an air conditioner, according to an embodiment of the disclosure. FIG. 4 shows a ventilation device, according to an embodiment of the disclosure. FIG. 5 shows an air discharge mode of a ventilation device, according to an embodiment of the disclosure. FIG. 6 shows an air supply mode of a ventilation device, according to an embodiment of the disclosure.

Referring to FIGS. 1 to 6, an air conditioner and a ventilation device thereof will now be described according to an embodiment of the disclosure.

An air conditioner 1 includes an indoor unit 2 installed indoors ID, an outdoor unit 30 installed outdoors OD, and a ventilation device 40 installed indoors ID. The indoor unit 2 may suck in indoor air, make the air go through heat exchange, and discharge the heat-exchanged air to indoor space.

The ventilation device 40 may ventilate indoor air and outdoor air. The ventilation device 40 may be attachable to or detachable from the indoor unit 2 in the form of a module. Alternatively, the ventilation device 40 may be installed to be separated from the indoor unit 2, or may be provided inside an indoor unit housing 4 of the indoor unit 2 to be incorporated with the indoor unit 2.

The indoor unit 2 may include the indoor unit housing 4, a blower unit 22 and 25 provided in the indoor unit housing 4, and a heat exchanger 3 provided to make the air brought into the indoor housing 4 undergo heat exchange.

The indoor housing 4 may include a case 11 in which the blower unit 22 and 25 and the heat exchanger 3 are installed, a front panel 20 coupled onto the front of the case 11, and filter frames 5 and 8 coupled onto the rear side of the case 11.

In a rear portion of the case 11, a first intake port 12 and a second intake port 13 may be formed. The first intake port 12 may be formed in an upper rear portion of the case 11. The second intake port 13 may be formed in a lower rear portion of the case 11. Indoor air may be sucked into the indoor unit housing 4 through the first and second intake ports 12 and 13.

A first discharge port 14 may be formed on the front of the case 11. The first discharge port 14 may be covered by a front panel 20. The air brought into the indoor unit housing 4 through the first intake port 12 may exchange heat with the heat exchanger 3 and may be discharged forward from the indoor unit housing 4 through the first discharge port 14.

The first filter frame 5 may be installed in the first intake port 12 to prevent foreign materials from being sucked into the indoor unit housing 4 through the first intake port 12. The first filter frame 5 may include a mesh-shaped first grill 6 and a first filter 7 provided to filter out foreign materials. The first filter 7 may include an electrostatic precipitate filter, a HEPA filter, an antimicrobial filter, a deodorizer filter, etc.

The second filter frame 8 may be installed in the second intake port 13 to prevent foreign materials from being sucked into the indoor unit housing 4 through the second intake port 13. The second filter frame 8 may be located under the first filter frame 5. The second filter frame 8 may include a mesh-shaped second grill 9 and a second filter 10 provided to filter out foreign materials. The second filter 10 may include an electrostatic precipitate filter, a HEPA filter, an antimicrobial filter, a deodorizer filter, etc.

A second discharge port 15 may be formed on the front of the case 11. The second discharge port 15 may be formed on the left-hand side and right-hand side to the first discharge port 14. The air brought into the indoor unit housing 4 through the second intake port 13 may be discharged forward from the indoor unit housing 4 through the second discharge port 15. The air brought into the indoor unit housing 4 through the second intake port 13 may be discharged to indoor space without going through heat exchange.

The indoor unit 2 may have a first flow path S1 connecting the first intake port 12 to the first discharge port 14, and a second flow path S2 connecting the second intake port 13 to the second discharge port 15. The first and second flow paths S1 and S2 may be separated from each other. This may prevent mixture of the air flowing in the first flow path S1 and the air flowing in the second flow path S2. To separate the first flow path S1 from the second flow path S2, there may be a partition plate 17 provided in the indoor unit 2.

The heat exchanger 3 may be arranged in the first flow path S1. No heat exchanger may be arranged in the second flow path S2. The heat exchanger 3 may include a header, a tube in which a refrigerant flows, and heat exchange fins attached to the tube to expand an electro thermal area.

An accommodation space 18 may be formed inside the case 11, and the second blower unit 25 and various kinds of electric parts required to operate the air conditioner 1 may be arranged in the accommodation space 18.

The blower units 22 and 25 may include the first blower unit 22 and the second blower unit 25. The first blower unit 22 may be arranged in the first flow path S1. The first blower unit 22 may bring air into the indoor unit housing 4 through the first intake port 12. The air brought in through the first intake port 12 may move along the first flow path S1 and exchange heat with the heat exchanger 3 and may be discharged out of the indoor unit housing 4 through the first discharge port 14. The first blower unit 22 may include a first blower fan 23 and a first fan driver 24.

The first blower fan 23 may be an axial flow fan that sucks in and discharge air in an axial direction or a mixed flow fan. However, the type of the first blower fan 23 is not limited thereto. The first fan driver 24 may include a motor.

The second blower unit 25 may be arranged in the second flow path S2. The second blower unit 25 may bring air into the indoor unit housing 4 through the second intake port 13. The air brought in through the second intake port 13 may move along the second flow path S2 and may be discharged out of the indoor unit housing 4 through the second discharge port 15. The second blower unit 25 may include a second blower fan 26, a second fan driver, and a fan case 27. The second blower fan 26 may be a cross flow fan. However, the type of the second blower fan 26 is not limited thereto. The second fan driver may include a motor.

A plurality of discharge holes 21 may be formed at the front panel 20 to penetrate the front panel 20. The air guided to the first discharge port 14 may slow down while passing the plurality of discharge holes 21 and may be discharged out of the indoor unit housing 4.

The plurality of discharge holes 21 may each have a tiny size and may be uniformly distributed in the entire area of the front panel 20. The air discharged through the plurality of discharge holes 21 may not reach directly to the user, and may gradually cool down or heat the indoor space.

The ventilation device 40 may be connected to a ventilation pipe 41. The ventilation pipe 41 may have the form of a flexible hose. The ventilation device 40 may be configured to switch between an air discharge mode to discharge indoor air to outdoor space through the ventilation pipe 41 and an air supply mode to supply outdoor air into indoor space through the ventilation pipe 41.

The ventilation device 40 may be attachable to or detachable from an outside of the indoor unit housing 4. The ventilation device 40 may include a hanger 68 to be coupled onto the outside of the indoor unit housing 4 of the indoor unit 2. The hanger 68 may have the form of a hook to be caught by and coupled to the outside of the indoor unit housing 4. As the ventilation device 40 is installed outside the indoor unit housing 4 in this way, there may be no need to put the ventilation pipe 41 into the indoor unit housing 4, and the work of connection between the ventilation device 40 and the ventilation pipe 41 may be easily made.

The ventilation device 40 may include a ventilation fan 70, and a ventilation motor 74 to drive the ventilation fan 70. In the disclosure, the ventilation device 40 may use the single ventilation pipe 41 and the single ventilation fan 70 to perform air supplying and air discharging.

The ventilation fan 70 may be a centrifugal fan that sucks in air in the axial direction and releases the air in the radial direction. The ventilation fan 70 may be driven by the ventilation motor 74.

The ventilation device 40 may include a ventilation device housing 51 for accommodating the ventilation fan 70 and the ventilation motor 74. The ventilation device housing 51 may include a main housing 60, and cover housings 52 and 54 coupled onto the outside of the main housing 60. The cover housings 52 and 54 may include the first cover housing 52 and the second cover housing 54. The first cover housing 52 and the second cover housing 54 may be provided to cover a portion of the main housing 60. A motor installation portion 53 in which to install the ventilation motor 74 may be formed at the first cover housing 52.

A ventilation inlet 55 may be formed at the second cover housing 54. Air sucked in through the ventilation inlet 55 may be guided into the main housing 60 through an entrance 62 of the main housing 60. A filter may be installed across the ventilation inlet 55 to prevent inflow of foreign materials.

The ventilation fan 70 may be installed inside the main housing 60. In the main housing 60, a ventilation fan entrance 71 through which to suck air into the ventilation fan 70 and a ventilation fan exit 72 through which to discharge air from the ventilation fan 70 may be formed.

The main housing 60 may include a ventilation outlet 63 through which to discharge air from inside the main housing 60 to the indoor space, and a ventilation inlet/outlet 61 which is coupled to the ventilation pipe 41 and through which to suck outdoor air into the main housing 60 or discharge air out of the main housing 60. The aforementioned hanger 68 may be formed to protrude from the main housing 60.

The ventilation outlet 63 may be arranged to be adjacent to the second intake port 13 of the indoor unit 2. Accordingly, the air discharged from the ventilation device 40 through the ventilation outlet 63 may be smoothly sucked into the indoor unit 2 through the second intake port 13 of the indoor unit 2.

The ventilation device 40 may be configured to be able to switch between the discharge mode to discharge indoor air to outdoor space through the ventilation pipe 41 and a supply mode to supply outdoor air into indoor space through the ventilation pipe 41.

For this, the ventilation device 40 may include a first damper 80 that allows the ventilation fan entrance 71 to be linked to one of the ventilation inlet 55 and the ventilation inlet/outlet 61 while preventing the ventilation fan entrance 71 from being linked to the other, and a second damper 90 that allows the ventilation fan exit 72 to be linked to one of the ventilation inlet/outlet 61 and the ventilation outlet 63 while preventing the ventilation fan exit 72 from being linked to the other.

The first damper 80 may include a cylindrical damper body 81 and a rotation shaft 88 formed to rotate the damper body 81, and may be arranged to be able to rotate. A first damper motor 89 may be installed in the main housing 60 to drive the first damper 80.

The cylindrical damper body 81 may include a bottom plane 82, a side plane 83 extending from edges of the bottom plane 82 to be perpendicular to the bottom plane 82, and an internal space 85 defined by the bottom plane 82 and the side plane 83.

The second damper 90 may include a rotatable shielding plate 91, and a rotation shaft 92 formed at an edge of the shielding plate 91 to rotate the shielding plate 91. A second damper motor (not shown) may be installed in the main housing 90 to drive the second damper 90.

The ventilation device 40 may include an intake flow path 66 that guides air sucked in through the ventilation inlet 55 to the entrance 71 of the ventilation fan 70, a discharge flow path 67 that guides air discharged from the ventilation fan 70 through the exit 72 of the ventilation fan 70 to the ventilation outlet 63, and an intake/discharge flow path 65 that guides air sucked in through the ventilation inlet/outlet 61 to the entrance 71 of the ventilation fan 70 or guides air discharged from the ventilation fan 70 through the exit 72 of the ventilation fan 70 to the ventilation inlet/outlet 61.

In the air discharge mode (see in FIG. 5), the first damper 80 is rotated for the entrance 71 of the ventilation fan 70 to be linked to the intake flow path 66, and the second damper 90 is rotated for the exit 72 of the ventilation fan 70 to be linked to the intake/discharge flow path 65.

Accordingly, when the ventilation fan 70 is operated in the air discharge mode, indoor air may sequentially pass the ventilation inlet 55, the intake flow path 66, the ventilation fan 70, the intake/discharge flow path 65, the ventilation inlet/outlet 61, and the ventilation pipe 41 to be discharged to the outdoor space.

In the air supply mode (see in FIG. 6), the first damper 80 is rotated for the entrance 71 of the ventilation fan 70 to be linked to the intake/discharge flow path 65, and the second damper 90 is rotated for the exit 72 of the ventilation fan 70 to be linked to the discharge flow path 67. Accordingly, when the ventilation fan 70 is operated in the air supply mode, indoor air may sequentially pass ventilation pipe 41, the ventilation inlet/outlet 61, the intake/discharge flow path 65, the ventilation fan 65, the discharge flow path 67, and the ventilation outlet 63 to be supplied into the indoor space.

The air discharged from the ventilation device 40 through the ventilation outlet 63 may flow into the indoor unit 2 through the second intake port 13 of the indoor unit 2 by suction force of the blower fan 26 of the indoor unit 2, and may then be purified by e.g., the second filter 10 equipped in the indoor unit 2 and supplied into the indoor space.

As described above, the ventilation device 40 may substantialize air supplying and air discharging through the single ventilation fan 70 and the single ventilation pipe 41.

The air conditioner 1 may include a refrigerant pipe 31 connecting between the indoor unit 2 and the outdoor unit 30. The refrigerant pipe 31 may pass through a hole 36 made on a building wall W to connect between the indoor unit 2 and the outdoor unit 30. The air conditioner 1 may include the ventilation pipe 41 connected to the ventilation device 40. The ventilation pipe 41 may ventilate indoor air and outdoor air through the hole 36 in which the refrigerant pipe 41 is installed.

In this way, the air conditioner 1 in an embodiment of the disclosure may include a pipe installation apparatus 100 to install the refrigerant pipe 31 and the ventilation pipe 41 through the single hole 36. The pipe installation apparatus 100 will now be described with reference to the drawings.

Figure 7:
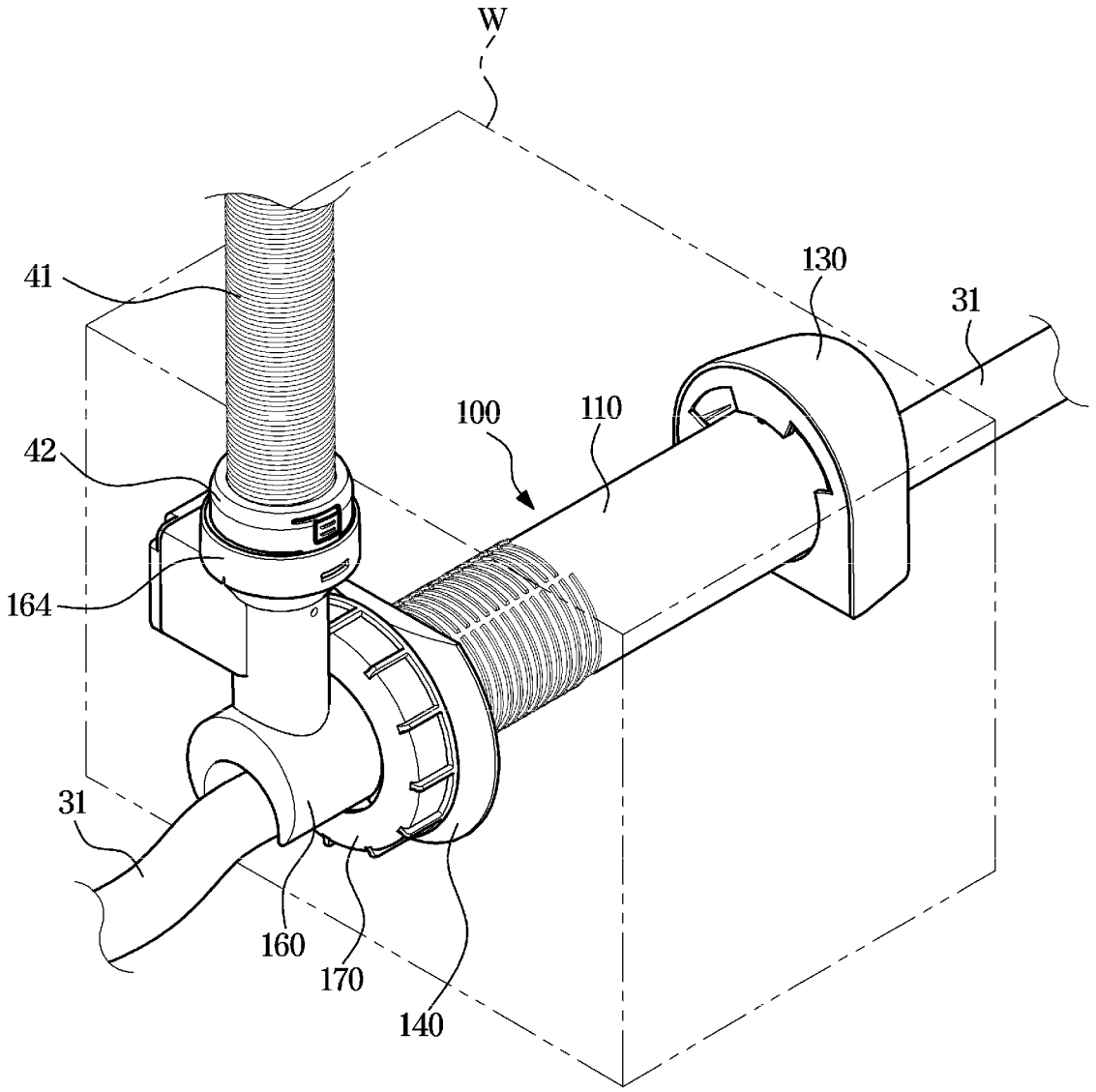
FIG. 7 shows a pipe installation apparatus, according to an embodiment of the disclosure.
Figure 8:
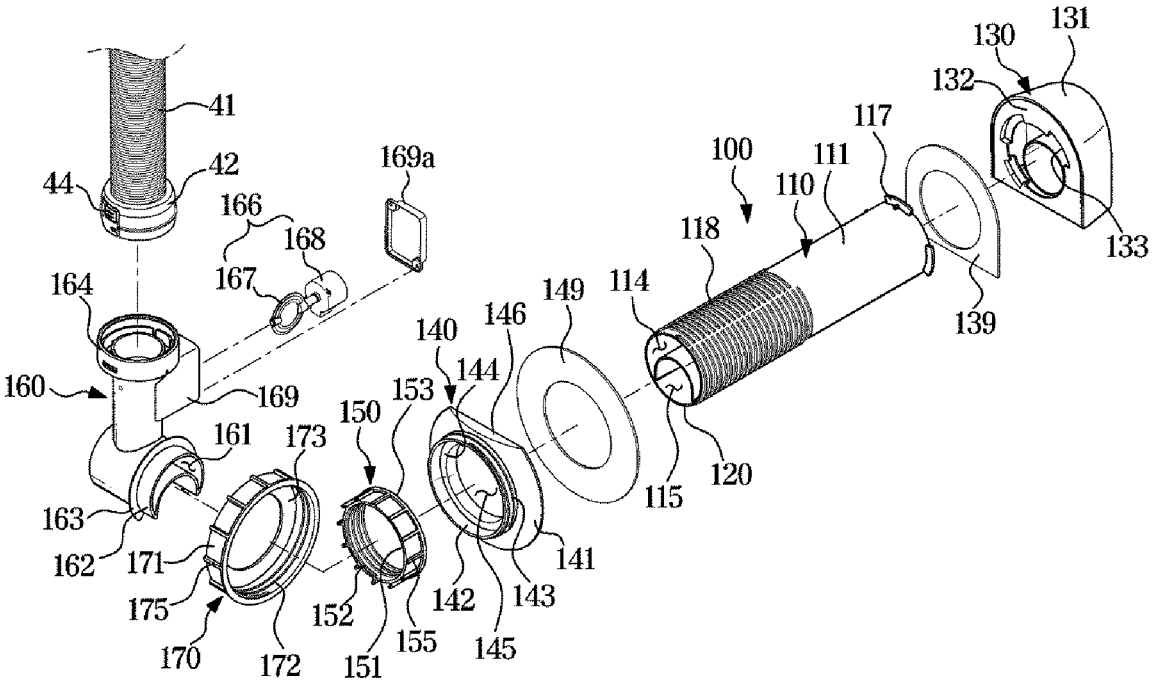
FIG. 8 is an exploded view of a pipe installation apparatus, according to an embodiment of the disclosure.
Figure 9:
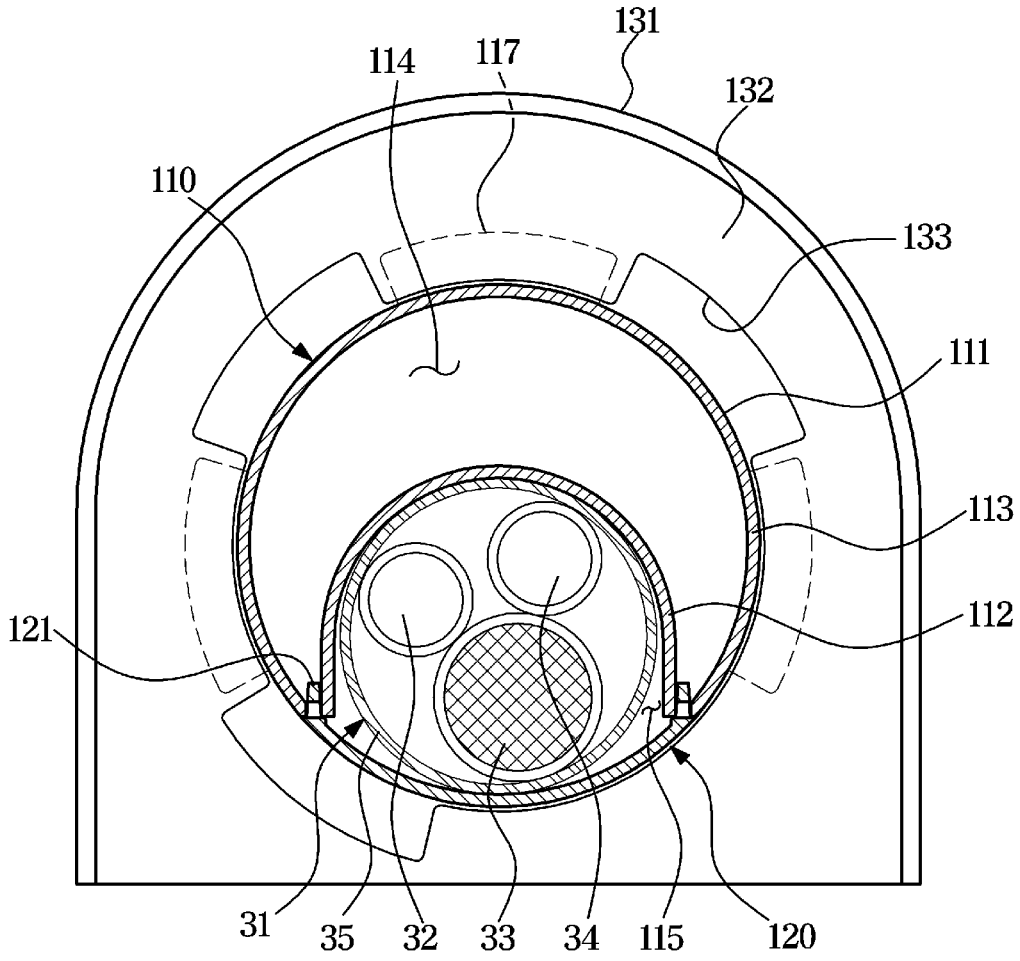
FIG. 9 is a front cross-sectional view of a sleeve of a pipe installation apparatus, according to an embodiment of the disclosure.
Figure 10:
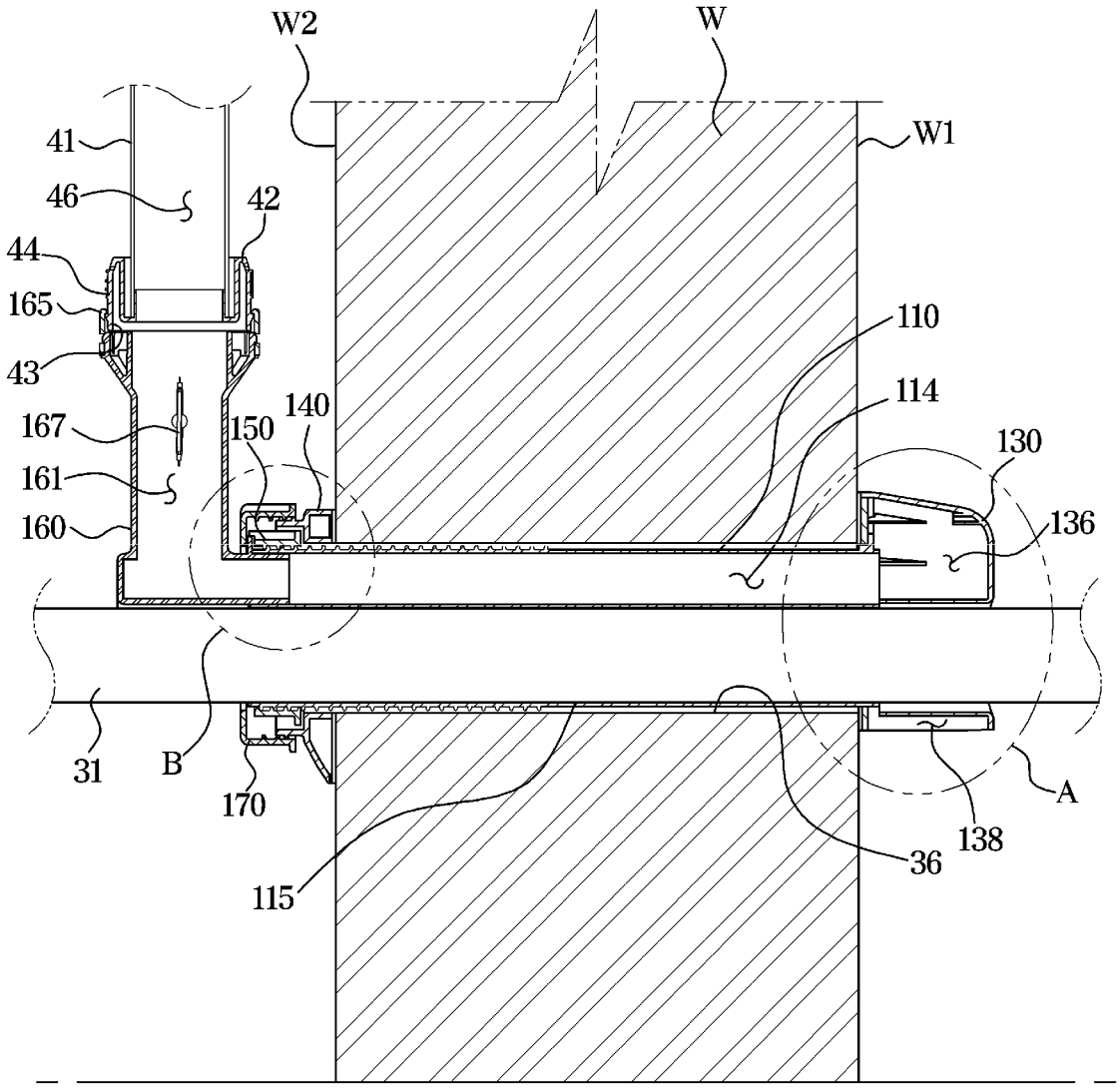
FIG. 10 is a side cross-sectional view of a pipe installation apparatus, according to an embodiment of the disclosure.
Figure 11:
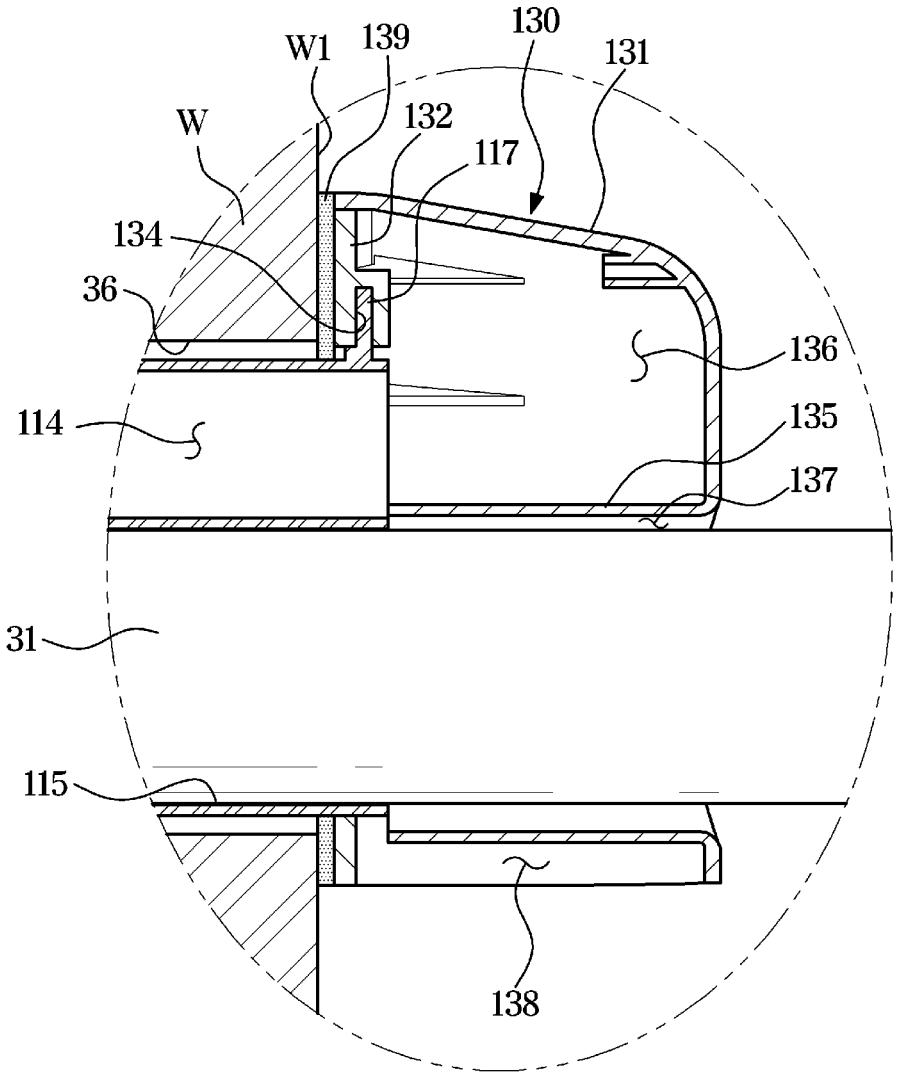
FIG. 11 is an enlarged view of portion A of FIG. 10.
Figure 12:
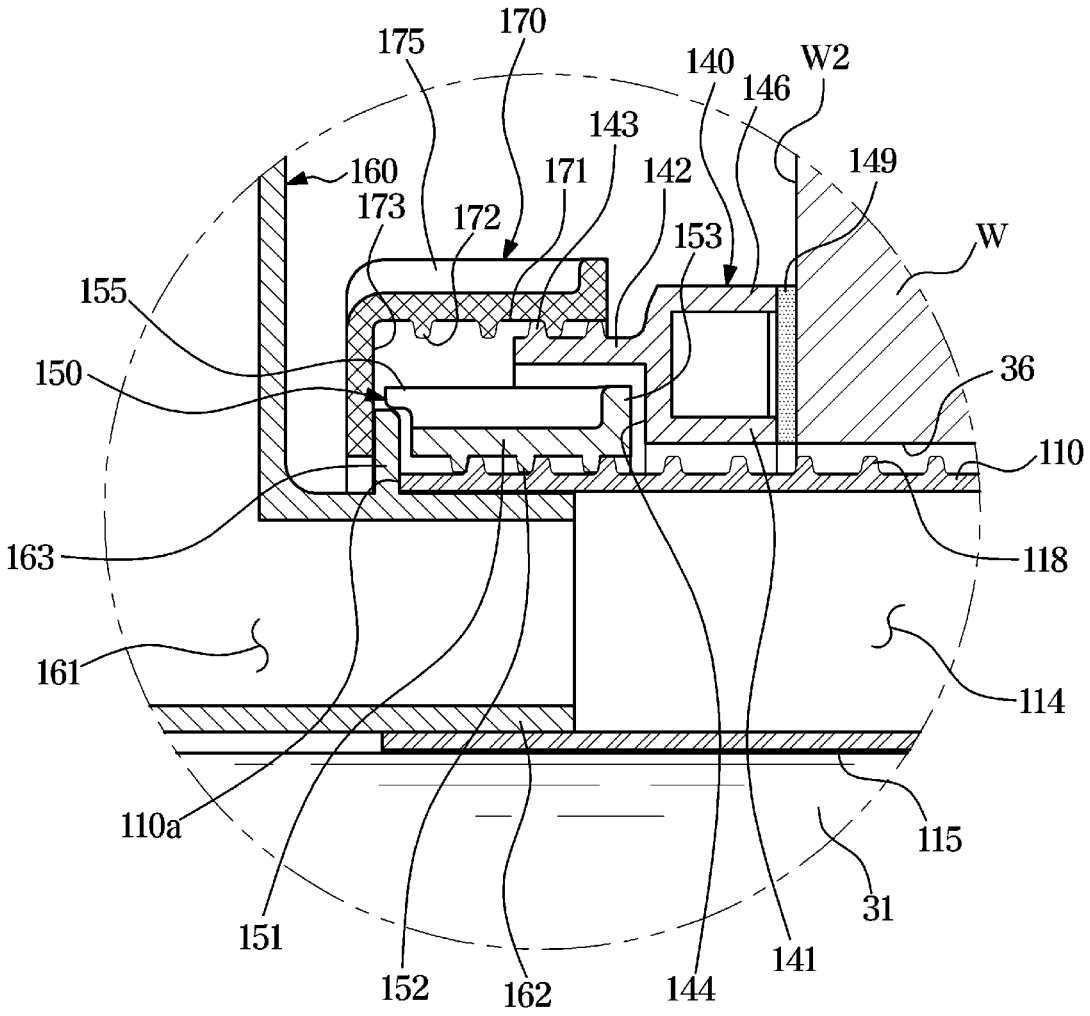
FIG. 12 is an enlarged view of portion B of FIG. 10.
Figure 13:
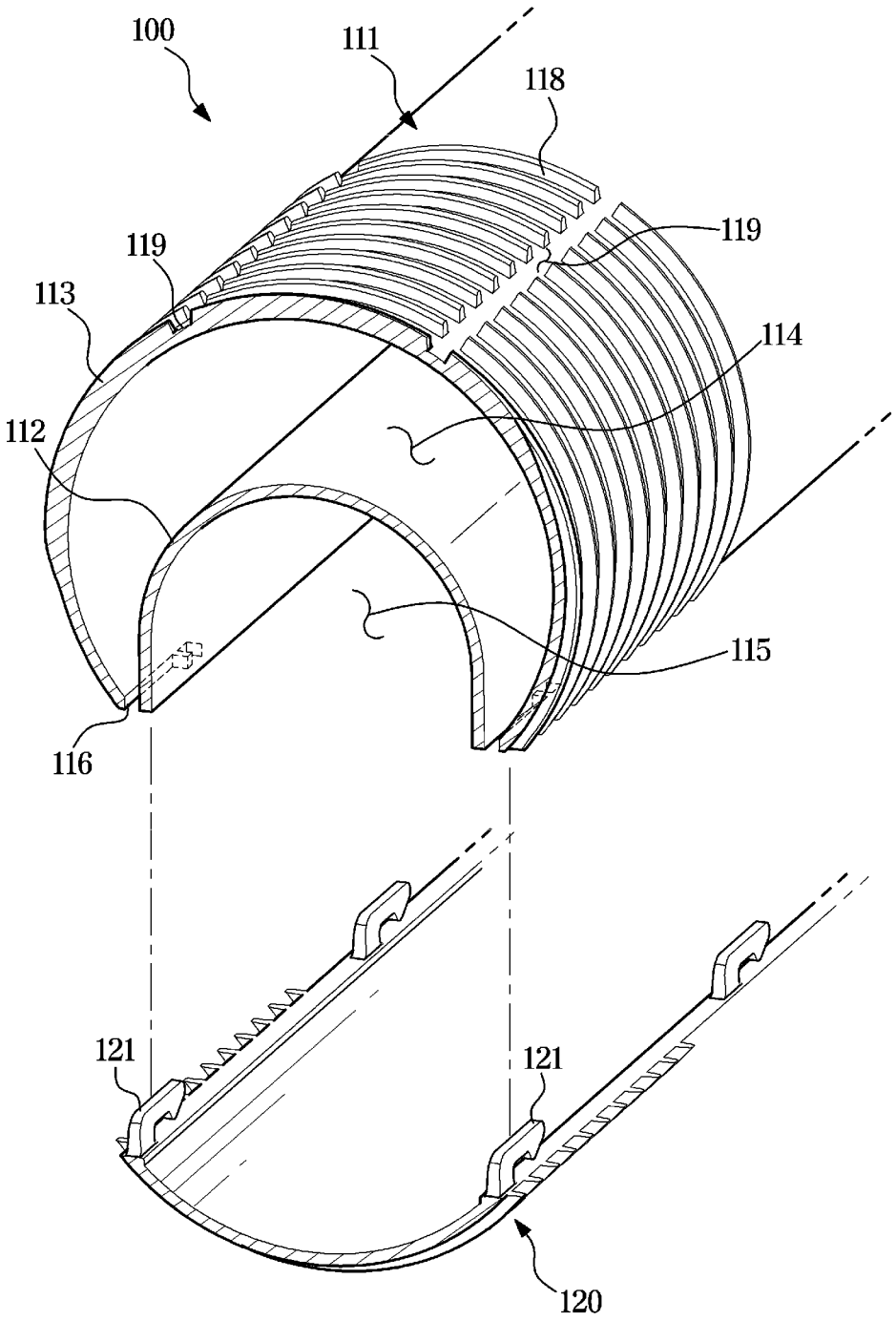
FIG. 13 is an exploded view of a sleeve of a pipe installation apparatus, according to an embodiment of the disclosure.
Figure 14:
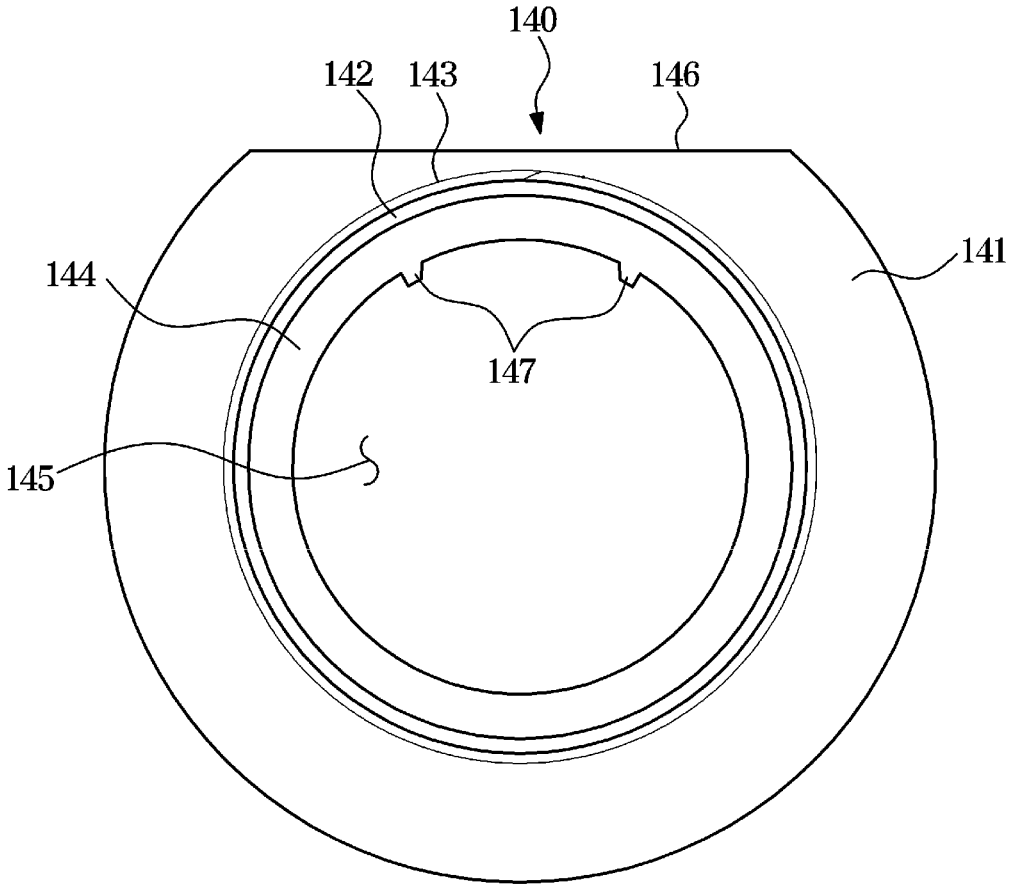
FIG. 14 shows a deco cap of a pipe installation apparatus, according to an embodiment of the disclosure.

FIG. 7 shows a pipe installation apparatus, according to an embodiment of the disclosure. FIG. 8 is an exploded view of a pipe installation apparatus, according to an embodiment of the disclosure. FIG. 9 is a front cross-sectional view of a sleeve of a pipe installation apparatus, according to an embodiment of the disclosure. FIG. 10 is a side cross-sectional view of a pipe installation apparatus, according to an embodiment of the disclosure. FIG. 11 is an enlarged view of portion A of FIG. 10. FIG. 12 is an enlarged view of portion B of FIG. 10. FIG. 13 is an exploded view of a sleeve of a pipe installation apparatus, according to an embodiment of the disclosure. FIG. 14 shows a deco cap of a pipe installation apparatus, according to an embodiment of the disclosure.

Referring to FIGS. 7 to 14, the pipe installation apparatus 100 includes a sleeve 110 installed to pass through the hole 36 formed in the building wall W.

The sleeve 110 may include a ventilation path 114 and a guide passage 115. The ventilation path 114 may be connected to an internal flow path 46 of the ventilation pipe 41 to ventilate indoor air and outdoor air. The refrigerant pipe 31 may pass through the guide passage 115. That is, the guide passage 115 may accommodate the refrigerant pipe 31. A cross-section perpendicular to a direction of length of the sleeve 110 may have the form corresponding to the hole 36. The cross-section perpendicular to the direction of length of the sleeve 110 may have a circular shape, and may have a diameter almost corresponding to the diameter of the hole 36.

The refrigerant pipe 31 may include a small refrigerant pipe 32 and a large refrigerant pipe 33, through which the refrigerant flows between the indoor unit 2 and the outdoor unit 30. The small refrigerant pipe 32 may be smaller in diameter than the large refrigerant pipe 33 and may guide a refrigerant liquid from the outdoor unit 30 to the indoor unit 2. The large refrigerant pipe 33 may be larger in diameter than the small refrigerant pipe 32 and may guide a refrigerant gas from the indoor unit 2 to the outdoor unit 30. The refrigerant pipe 31 may include a drain hose 34 to drain condensate water produced by the heat exchanger 3 of the indoor unit 2.

The refrigerant pipe 31 may include a tape 35 to bind the small refrigerant pipe 32, the large refrigerant pipe 33, and the drain hose 34 together. The small refrigerant pipe 32, the large refrigerant pipe 33, and the drain hose 34 may be wrapped by the tape 35 to be bound together. The tape 35 may exert binding, warming, and protecting functions.

The ventilation path 114 may be concavely formed to accommodate at least a portion of the guide passage 115. Accordingly, the ventilation path 114 may approximately have a crescent form. In this way, the ventilation path 114 is formed to accommodate at least a portion of the guide passage 115, so that the size of the hole 36 to be made at the building wall W may be minimized.

Furthermore, the sleeve 110 may include a sleeve body 111 having an inner wall 112 and an outer wall 113. The ventilation path 114 may be formed between the inner wall 112 and the outer wall 113. The outer wall 113 may have a circular cross-section. The inner wall 112 may be convexly formed toward the ventilation path 114. The guide passage 115 may be formed outside the inner wall 112 to be shaped like a groove with one side open.

The sleeve 110 may include a sleeve cover 120 coupled to the sleeve body 111 to cover the open side of the guide passage 115. For this, a coupling groove 116 may be formed at the sleeve body 111, and a coupling hook 121 may be formed at the sleeve cover 120 to be stuck in the coupling groove 116. The sleeve 110 may be formed by combining the sleeve body 111 and the sleeve cover 120.

The sleeve 110 may be formed of a rigid material. Accordingly, the sleeve 110 may be easily installed in the hole 36 of the building wall W, and may reliably accommodate the refrigerant pipe 31 of a flexible material.

A sleeve male screw 118 may be formed on the outer circumferential surface of the sleeve 110 for a fixer 150 to be screwed thereto.

The pipe installation apparatus 100 may further include a hood cap 130 arranged at an end on the outdoor side of the sleeve 110, and a deco cap 140 arranged at an end on the indoor side of the sleeve 110. The hood cap 130 may be supported by an outer side W1 of the building wall W, and the deco cap 140 may be supported by an inner side W2 of the building wall W. Consequently, the hood cap 130 and the deco cap 140 arranged at either end of the sleeve 100 are supported by the building wall W, so that the sleeve 110 may be fixed in the hole 36.

The hood cap 130 may prevent rain water or foreign materials from flowing into the ventilation path 114 and the guide passage 115. The hood cap 130 may be separately provided from the sleeve 110 and coupled to the end on the outdoor side of the sleeve 110. For this, a sticking projection 117 may be formed on the sleeve 110 to protrude from the outer circumferential surface of the sleeve 110 and a catching groove 134 may be formed on the hood cap 130 to catch the sticking projection 117. Alternately, the sleeve 110 and the hood cap 130 may be integrally formed.

The hood cap 130 may include a hood cap body 131 in which an extension flow path 136 and an extension passage 137 are formed, and a hood support plate 132 coupled to the hood cap body 131 to be supported by the outer side W1 of the building wall W. A projection insertion groove 133 may be formed at the hood support plate 132 for the sticking projection 117 to be put into the hood cap 130 while the sleeve 110 and the hood cap 130 are assembled. When the hood cap 130 is rotated after the sticking projection 117 is put into the hood cap 130 through the projection insertion groove 133, the sticking projection 117 may be inserted to the catching groove 134.

The extension flow path 136 may be linked to the ventilation path 114 of the sleeve 110 to ventilate indoor air to outside of the wall or outdoor air to inside of the wall. An air passage port 138 connected to the extension flow path 136 may be formed at the bottom of the hood cap 130 to prevent rain water and foreign materials from flowing in.

The extension passage 137 in the hood cap 130 may be connected to the guide passage 115 of the sleeve 110 to guide the refrigerant pipe 31. The hood cap 130 may include a partition 135 to separate the extension flow path 136 from the extension passage 137. The extension flow path 136 and the extension passage 137 may not be connected due to the partition 135.

An outer sealing member 139 formed of such a material as silicon may be provided between the hood cap 130 and the outer side W1 of the building wall W.

The deco cap 140 may serve to protect e.g., wallpaper applied on the building wall W as well as reliably fix the sleeve 110 with the hood cap 130.

The deco cap 140 may be separately provided from the sleeve 110 and coupled to the end on the indoor side of the sleeve 110. The deco cap 140 may be coupled to the sleeve 100 in a manner that the sleeve 110 is inserted to a cavity 145 of the deco cap 140. The fixer 150 may force the deco cap 140 to tightly contact the inner side W2 of the building wall W, so that the deco cap 140 may be fixed to the end on the indoor side of the sleeve 110.

The deco cap 140 may include a deco supporter 141 formed to be supported by the inner side W2 of the building wall W, a deco cylinder 142 having the form of a cylinder extending from the deco supporter 141, and a contact 144 pressurized by the fixer 150 and formed to be supported by the inner side W2 of the building wall W. A deco male screw 143 may be formed on the outer circumferential surface of the deco cylinder 142 for a holder 170 to be screwed thereto.

An inner sealing member 149 formed of such a material as silicon may be provided between the deco cap 140 and the inner side W2 of the building wall W.

The deco cap 140 may include an indicator 146 to guide the pipe installation apparatus 100 to be installed in a right direction. The indicator 146 may be formed on the top of the deco supporter 141 in the form of a flat plane. The indicator 146 may enable the user to easily recognize a current direction of the deco cap 140, and the user may be able to install the deco cap 140 in the right direction by rotating the deco cap 140 until the indicator 146 is leveled.

The deco cap 140 may include an alignment projection 147 to guide the sleeve 110 to be installed in a direction corresponding to a direction of the deco cap 140. The alignment projection 147 may protrude into the cavity 145 of the deco cap 140 (see FIG. 14).

Alignment grooves 119 may be formed at the sleeve 110 for the alignment projection 147 to be inserted thereto. The alignment grooves 119 may be formed at the sleeve male screw 118 formed on the outer circumferential surface of the sleeve 110 along a direction of length of the sleeve 110 (see FIG. 13).

When the sleeve 110 is inserted to the cavity 145 of the deco cap 140, the alignment projection 147 of the deco cap 140 may be inserted to the alignment groove 119 of the sleeve 110. Accordingly, the deco cap 140 and the sleeve 110 may be rotated together, and when the deco cap 140 is installed in the right direction, the sleeve 110 may be installed in the right direction as well.

The pipe installation apparatus 100 may further include the fixer 150. The fixer 150 may force the deco cap 140 to tightly contact the side of the building wall W, so that the deco cap 140 may be fixed to the sleeve 110. The fixer 150 may include a fixer cylinder 151 having the form of a cylinder, and a fixer pressurizer 153 formed to pressurize the contact 144 of the deco cap 140.

The fixer 151 may be coupled to the sleeve by screwing. For this, a fixer female screw 152 may be formed on the inner circumferential surface of the fixer cylinder 151 to be coupled to the male screw 118 of the sleeve 110 by screwing. A fixer manipulation projection 155 may be formed on the outer circumferential surface of the fixer cylinder 151 to facilitate rotation of the fixer 150.

The pipe installation apparatus 100 may include a connecting pipe 160 coupled between the ventilation pipe 41 and the sleeve 110 to link the internal flow path 46 of the ventilation pipe 41 to the ventilation path 114 of the sleeve 110.

The connecting pipe 160 may include an insertion tube 162 formed to be coupled to the sleeve 10, a connecting pipe connector 164 formed to be coupled to the ventilation pipe 41, and a connection flow path 161 linked to the internal flow path 46 of the ventilation pipe 41.

The insertion tube 162 may be coupled to the sleeve 110 in a manner that the insertion tube 162 is inserted to the ventilation path 114. Insertion depth of the insertion tube 162 may be limited by a flange 163 of the connecting pipe 160. The connection flow path 161 may have a cross-section of a form that corresponds to the cross-section of the ventilation path 114.

The connecting pipe connector 164 may be coupled to a pipe connector 42 arranged at an end of the ventilation pipe 41. Once the pipe connector 42 is inserted to the connecting pipe connector 164, a connecting hook 43 of the pipe connector 42 may be caught by a connecting projection 165 of the connecting pipe connector 164, so that the pipe connector 42 and the connecting pipe connector 164 may be coupled together.

The pipe connector 42 and the connecting pipe connector 164 may be attachable to and detachable from each other, and for this, there may be a release button 44 arranged on the pipe connector 42 to move the connecting hook 43.

As a pipe connector 45 may be provided at an end of the ventilation pipe 41 on the side of the ventilation device 40 and a ventilation device connector 69 to be connected to the pipe connector 45 may be provided in the ventilation device 40, the ventilation pipe 41 and the ventilation device 40 may be coupled in the same manner.

An opening/closing device 166 to open or close the connection flow path 161 may be provided at the connecting pipe 160. In a case that ventilation is not required, the opening/closing device 166 closes the connection flow path 161 to prevent bugs or foreign materials from invading into the indoor space through the connection flow path 161.

The opening/closing device 166 may include an opening/closing damper 167 that is rotatable with a form corresponding to the cross-section of the connection flow path 161 to close the connection flow path 161, and an opening/closing motor 168 to drive the opening/closing damper 167 to be rotated. A motor housing 169 to accommodate the opening/closing motor 168 may be formed at the connecting pipe 160, and a motor housing cover 169*a* may be coupled to the motor housing 169 to cover the motor housing 169.

The connecting pipe 160 may be fixed by the holder 170. Specifically, the connecting pipe 160 may be fixed to the sleeve 100 when the holder 170 forces the deco cap 140 to tightly contact an end 110*a* of the sleeve 100.

For this, the connecting pipe 160 may include the flange 163 that is pressurized by the holder 170 and formed to be supported by the end 110*a* on the indoor side of the sleeve 110. The flange 163 may be formed to protrude outward in the radial direction from the insertion tube 162.

The holder 170 may fix the connecting pipe 160 to the sleeve 110. The holder 170 may be coupled to the deco cap 140 by screwing. The holder 170 may include a holder cylinder 171 having the form of a cylinder, and a holder pressurizer 173 formed to pressurize the flange 163 of the connecting pipe 160. The holder cylinder 171 may have a larger diameter than that of the insertion tube 162 of the connecting pipe 160, and the holder pressurizer 173 may extend from the holder cylinder 171 inward in the radial direction.

A holder female screw 172 may be formed on the inner circumferential surface of the holder cylinder 171 to be coupled to the male screw 143 of the deco cap 140 by screwing. A holder manipulation projection 175 may be formed on the outer circumferential surface of the holder cylinder 171 to facilitate rotation of the holder 170.

In this way, the holder 170 is coupled to the deco cap 140 in a screw coupling method, and the holder 170 may be decoupled from the deco cap 140 by rotating the holder 170 in an opposite direction to a direction of coupling the holder 170. When the holder 170 is decoupled from the deco cap 140, the connecting pipe 160 may be separated from the sleeve 110 by pulling the insertion tube 162 of the connecting pipe 160 from the sleeve 110.

A method of installing the refrigerant pipe 31 and the ventilation pipe 41 through the pipe installation apparatus 100 configured as described above will now be briefly described.

The sleeve 110 is arranged to pass through the hole 36 of the building wall W.

The hood cap 130 is coupled to an end on the outdoor side of the sleeve 110.

The deco cap 140 is put into an end on the indoor side of the sleeve 110, and the fixer 150 is coupled to the sleeve 110 by screwing. The hood cap 130 coupled to the end on the outdoor side of the sleeve 110 may be supported by the outer side W1 of the building wall W and the deco cap 140 coupled to the end on the indoor side of the sleeve 110 may be supported by the inner side W2 of the building wall W, so that the sleeve 110 may be reliably fixed in the hole 36.

The insertion tube 162 of the connecting pipe 160 is inserted to the ventilation path 114 of the sleeve 110, and holder 170 is coupled to the deco cap 140 by screwing. As the flange 163 of the connecting pipe 160 is supported between the holder pressurizer 173 of the holder 170 and the end 110*a* of the sleeve 110, the connecting pipe 160 may be fixed.

When the pipe connector 42 of the ventilation pipe 41 is coupled to the connecting pipe connector 164 of the connecting pipe 160, the internal flow path 46 of the ventilation pipe 41 and the ventilation flow path 114 of the sleeve 110 may be linked.

The indoor unit 2 and the outdoor unit 30 are connected by the refrigerant pipe 31 passing through the guide passage 115 of the sleeve 110.

Figure 15:
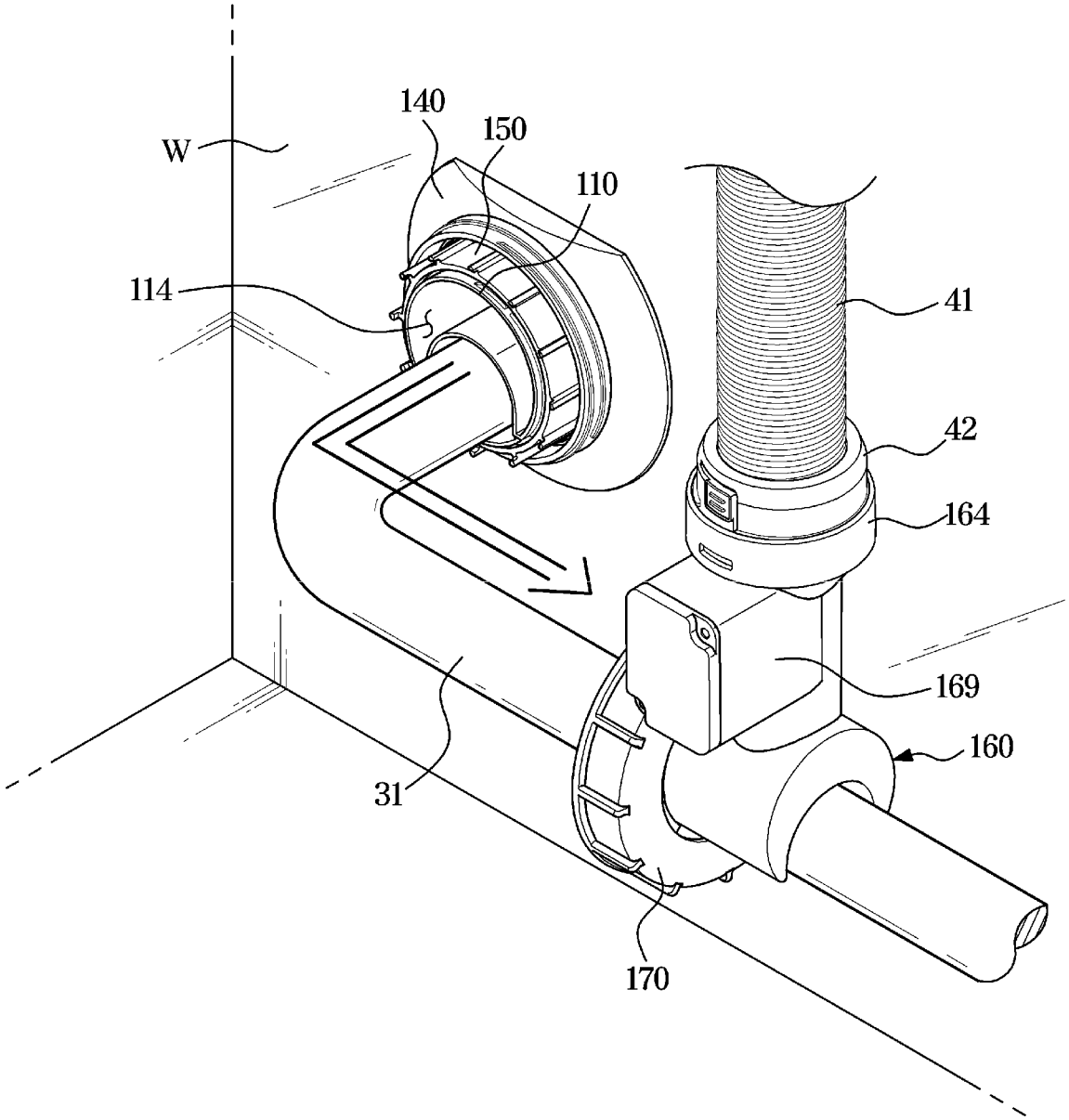
FIG. 15 shows a connecting pipe of a pipe installation apparatus being separated from a sleeve, according to an embodiment of the disclosure.

FIG. 15 shows a connecting pipe of a pipe installation apparatus being separated from a sleeve, according to an embodiment of the disclosure.

As described above, the connecting pipe 160 is fixed by the holder 170 to the sleeve 110, and the holder 170 is coupled to the deco cap 140 in a screw coupling method. The holder 170 may be decoupled from the deco cap 140 by rotating the holder 170 in an opposite direction to a direction of coupling the holder 170. When the holder 170 is decoupled, the connecting pipe 160 may be separated from the sleeve 110 by pulling the insertion tube 162 of the connecting pipe 160.

Once the connecting pipe 160 is separated from the sleeve 110 this way, the ventilation path 114 of the sleeve 110 is exposed, in which case the ventilation path 114 may be cleaned using e.g., a long brush.

Figure 16:
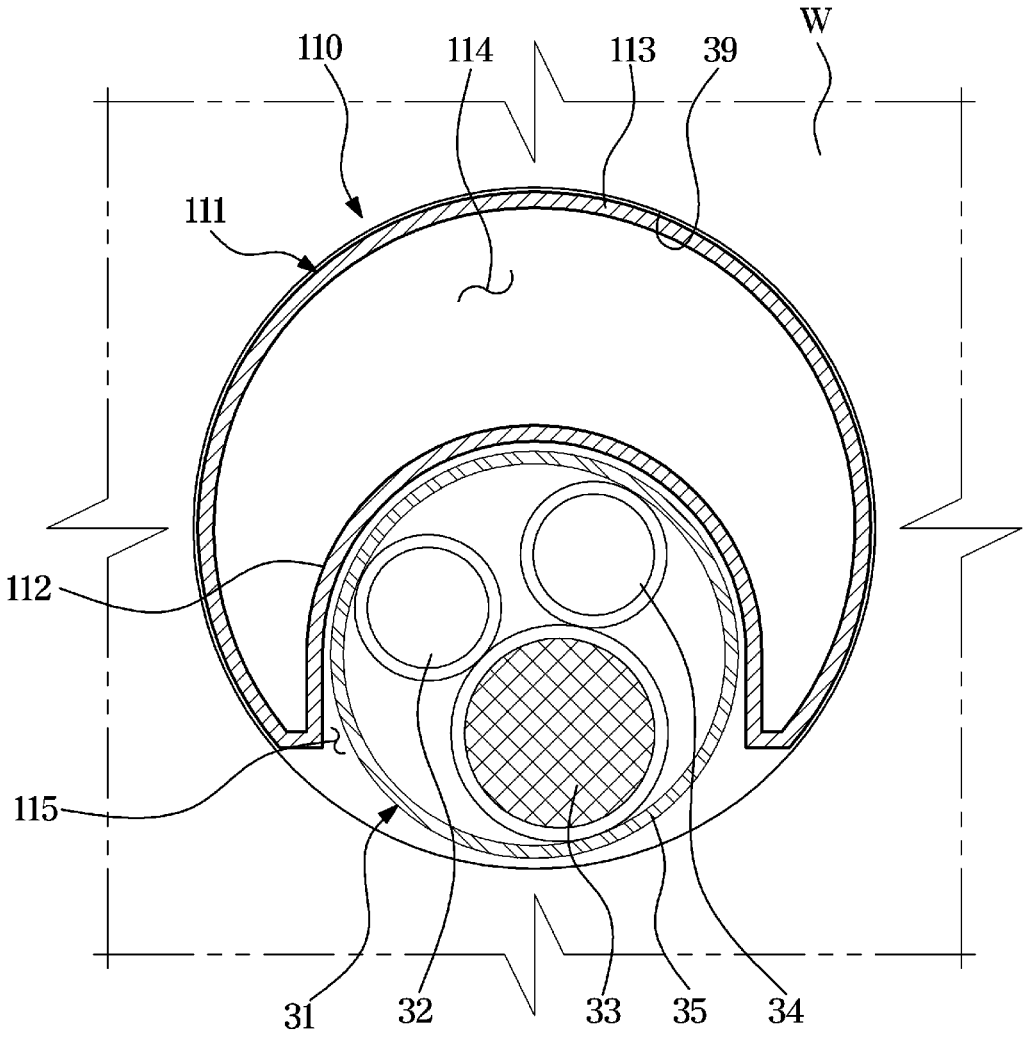
FIG. 16 is a cross-sectional view of a sleeve of a pipe installation apparatus, according to another embodiment of the disclosure.

FIG. 16 is a cross-sectional view of a sleeve of a pipe installation apparatus, according to another embodiment of the disclosure.

Referring to FIG. 16, a pipe installation apparatus according to another embodiment of the disclosure will be described. The same elements as in the aforementioned embodiment of the disclosure are given the same reference numerals, and the overlapping description will not be repeated.

Unlike in the previous embodiment of the disclosure, the sleeve 110 may not include the sleeve cover 120. Specifically, the sleeve 110 may just include the sleeve body 110 having the inner wall 112 and the outer wall 113. The sleeve 110 may include the ventilation path 114 formed between the inner wall 112 and the outer wall 113 and linked to the internal flow path 46 of the ventilation pipe 41, and the guide passage 115 formed outside the inner wall 112 in the form of a groove to accommodate the refrigerant pipe 31.

Figure 17:
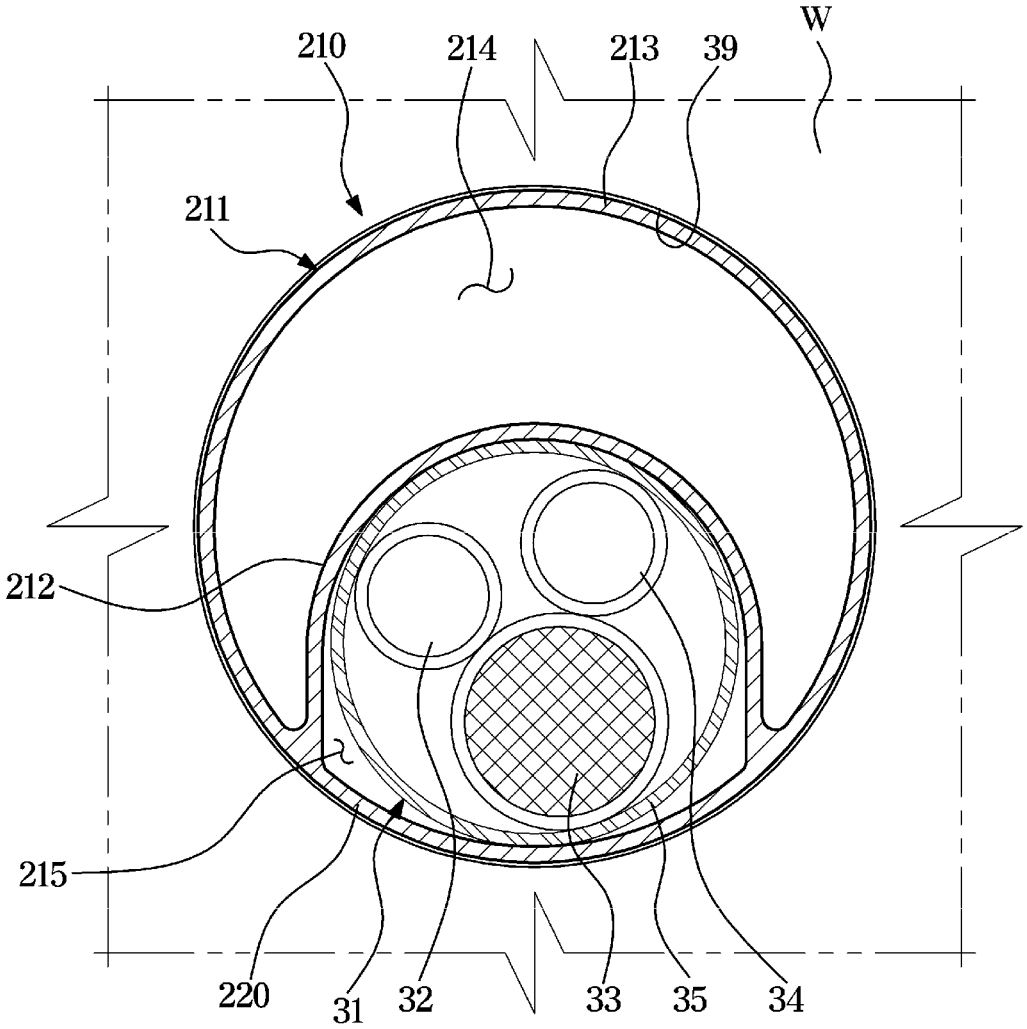
FIG. 17 is a cross-sectional view of a sleeve of a pipe installation apparatus, according to another embodiment of the disclosure.

FIG. 17 is a cross-sectional view of a sleeve of a pipe installation apparatus, according to another embodiment of the disclosure.

Referring to FIG. 17, a pipe installation apparatus according to another embodiment of the disclosure will be described. The same elements as in the aforementioned embodiment of the disclosure are given the same reference numerals, and the overlapping description will not be repeated.

Unlike in the previous embodiments, the sleeve body and the sleeve cover may be integrally formed. Specifically, the sleeve 210 may include a sleeve body 211 having an inner wall 212, a first outer wall 213, and a second outer wall 220.

A ventilation path 214 may be formed between the inner wall 212 and the first outer wall 213 to be linked to the internal flow path 46 of the ventilation path 41, and a guide passage 215 may be formed between the inner wall 212 and the second outer wall 220 to accommodate the refrigerant pipe 31.

Cross-sections of the first outer wall 213 and the second outer wall 220 may each have the form of a circle to correspond to the hole 36. The inner wall 212 may separate the ventilation path 214 from the guide passage 215, and may be concavely formed toward the ventilation path 214. The ventilation path 214 may have a crescent shaped cross-section.

Figure 18:
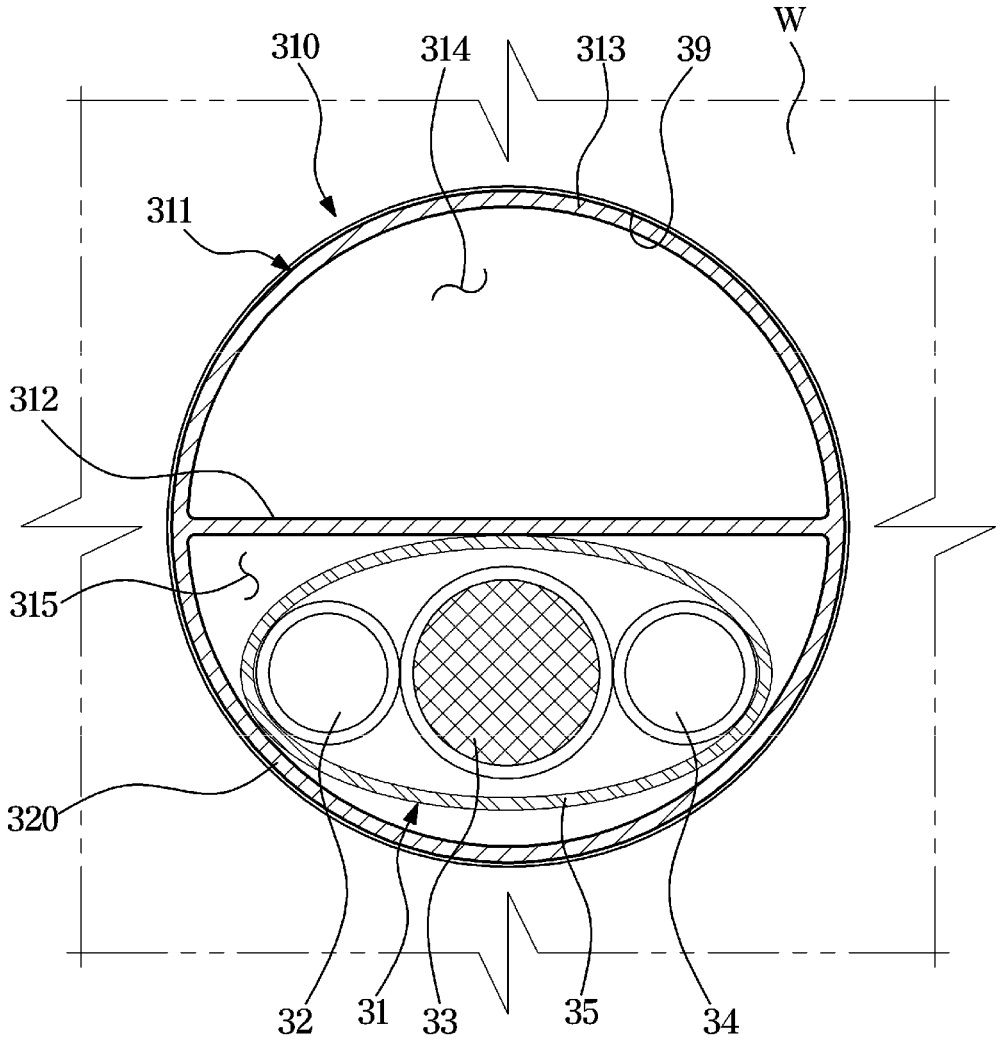
FIG. 18 is a cross-sectional view of a sleeve of a pipe installation apparatus, according to another embodiment of the disclosure.

FIG. 18 is a cross-sectional view of a sleeve of a pipe installation apparatus, according to another embodiment of the disclosure.

Referring to FIG. 18, a pipe installation apparatus according to another embodiment of the disclosure will be described. The same elements as in the aforementioned embodiment of the disclosure are given the same reference numerals, and the overlapping description will not be repeated.

Specifically, the sleeve 310 may include a sleeve body 311 having an inner wall 312, a first outer wall 313, and a second outer wall 320.

A ventilation path 314 may be formed between the inner wall 312 and the first outer wall 313 to be linked to the internal flow path 46 of the ventilation path 41, and a guide passage 315 may be formed between the inner wall 312 and the second outer wall 320 to accommodate the refrigerant pipe 31.

Cross-sections of the first outer wall 313 and the second outer wall 320 may each have the form of a circle to correspond to the hole 36. The inner wall 312 may separate the ventilation path 314 from the guide passage 315. However, unlike in the embodiment of FIG. 17, the inner wall 312 may have the form of a flat plate. Accordingly, the ventilation path 314 and the guide passage 315 may each have a half-circular cross-section.

According to embodiments of the disclosure, a single hole is made for a refrigerant pipe and a ventilation pipe of an air conditioner to be installed therein.

According to embodiments of the disclosure, a hole to be made on a wall to install a refrigerant pipe and a ventilation pipe may be minimized in size.

According to embodiments of the disclosure, a refrigerant pipe and a ventilation pipe may be easily installed, maintained and repaired.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

What is claimed is:

1. An air conditioner comprising:

an indoor unit to be installed in indoor space;

an outdoor unit to be installed in outdoor space, the outdoor unit to be separated by a wall from the indoor space;

a refrigerant pipe to connect the indoor unit with the outdoor unit;

a ventilation pipe to connect the indoor unit to the outdoor space;

a ventilation device having a fan and a motor to drive, the ventilation device to be arranged in the indoor space and to be connected to the ventilation pipe to ventilate indoor air in the indoor space to the outdoor space in a first operation mode or outdoor air in the outdoor space to the indoor space through the ventilation pipe in a second operation mode;

a sleeve to be installed to pass through a hole formed at the wall to guide the refrigerant pipe and the ventilation pipe therethrough, the sleeve comprising a ventilation path formed therein to be connected to an internal flow path formed in the ventilation pipe and a guide passage formed therein for the refrigerant pipe to pass through;

a connecting pipe to connect the internal flow path of the ventilation pipe to the ventilation path of the sleeve;

a deco cap arranged at an end on an indoor side of the sleeve to be supported by an inner side of the wall; and a holder coupled to the deco cap to fix the connecting pipe.

2. The air conditioner of claim 1, wherein the ventilation path is concavely formed to accommodate at least a portion of the guide passage.

3. The air conditioner of claim 1, wherein the sleeve comprises a sleeve body including an inner wall which separates the ventilation path from the guide passage and an outer wall having the ventilation path formed between the outer wall and the inner wall.

4. The air conditioner of claim 3, wherein the guide passage is formed to have one side thereof open, and the sleeve further comprises a sleeve cover to cover the open side of the guide passage.

5. The air conditioner of claim 4, wherein the sleeve body and the sleeve cover are attachable to each other to be coupled or detachable from each other to be uncoupled.

6. The air conditioner of claim 4, wherein the sleeve body and the sleeve cover are integrally formed.

7. The air conditioner of claim 1, wherein the air conditioner further comprising a hood cap arranged at an end on an outdoor side of the sleeve to be supported by an outer side of the wall.

8. The air conditioner of claim 7, wherein the hood cap comprises an extension flow path formed therein to be connected to the ventilation path and an extension passage formed therein to be connected to the guide passage.

9. The air conditioner of claim 1, wherein the deco cap comprises an alignment projection formed therein to guide the sleeve to be fixed to the deco cap.

10. The air conditioner of claim 9, wherein the air conditioner further comprising a fixer to be coupled to the sleeve to fix the deco cap.

11. The air conditioner of claim 1, wherein the air conditioner further comprising a damper provided at the connecting pipe to allow or prevent ventilation of the indoor air or the outdoor air.

12. The air conditioner of claim 1, wherein the holder coupled to the deco cap to fix the connecting pipe by forcing the deco cap to tightly contact an end of the sleeve.

13. The air conditioner of claim 1, wherein the ventilation device is configured to switch between an air discharge mode to discharge the indoor air to the outdoor space through the ventilation pipe and an air supply mode to supply the outdoor air into the indoor space through the ventilation pipe.

* * * * *